United States Patent [19]

Lorenzo

[11] Patent Number: 5,077,454

[45] Date of Patent: Dec. 31, 1991

[54] ACTUATOR DEVICE FOR A FINGERTIP SWITCH

[75] Inventor: Angel R. Lorenzo, San Boi de Llobregat, Spain

[73] Assignee: Industrias Lorenzo S.A., Barcelona, Spain

[21] Appl. No.: 518,704

[22] Filed: May 4, 1990

[30] Foreign Application Priority Data

May 4, 1989 [ES] Spain ..... 8901807[U]

[51] Int. Cl.[5] ..... H01H 3/42; H01H 9/02

[52] U.S. Cl. ..... 200/573; 200/296

[58] Field of Search ..... 200/573, 296, 533, 295, 200/330, 241, 61.1, 61.11, 345, 341, 331, 344

[56] References Cited

U.S. PATENT DOCUMENTS 4,419,555 12/1983 Kim ..... 200/533
4,454,397 6/1984 Kim ..... 200/296
4,965,420 10/1990 Phillips et al. ..... 200/573

*Primary Examiner*—Henry J. Recla
*Assistant Examiner*—David J. Walczak
*Attorney, Agent, or Firm*—Fleit, Jacobson, Cohn, Price, Holman & Stern

[57] ABSTRACT

A fingertip push button switch device has an electrical insulated hollow casing (1) having an externally threaded wall to be inserted through and mounted in an aperture in a support panel and secured by a fastening nut (16) engaging the threaded wall, a first upper recess in one end of the hollow casing, a second lower and smaller recess on the opposite end of the hollow casing for receiving in use part of a switch body (11) having a depressable actuating switch (10) protruding therefrom, an intermediate wall (2) on the casing between the recesses, a hollow drive push button (10) in the first recess, a spring (3) between the intermediate wall (2) and the push button (4) resiliently urging the push button outwardly of the first recess, three circumferentially spaced holes (7, 9) through the intermediate wall (2), three elastic legs (6, 8) extending axially from the push button (4) through the holes in the intermediate wall (2), two (6) of the three axial legs being arranged diametrically opposite to each other for guiding and retaining the push button (4) in the casing (1) and a third axial leg (8) being offset 90 degrees from the other two axial legs (6), a protrusion (12) on the third leg (8) for depressing the actuating switch (10) when the push button (10) is depressed in the first recess against the force of the spring (3), guide means (18) in the second recess for guiding the switch body (11) during insertion thereof into the second recess, and two resilient oppositely spaced appendages extending from the casing outwardly from the second recess and having facing sides for engaging therebetween the switch body (11) when inserted in the second recess, and retaining stubs (15) on the distal ends of the appendages (14) for retaining the switch body in the second recess.

4 Claims, 2 Drawing Sheets

ACTUATOR DEVICE FOR A FINGERTIP SWITCH

BACKGROUND OF THE INVENTION

1. Field of the invention

This invention relates to an actuator device for a fingertip switch of the type suitable in particular, to switches intended for driving entertainment machines and the like.

2. Description of the prior art

Prior actuator devices of the mentioned type comprise a casing formed by an electrical insulated hollow body, with its external wall threaded in order to be mounted in an aperture in a support panel and secured by a fastening nut. The casing includes an open bottom with a first recess that lodges a floating push button, with a spring urging the push button toward an inactive position. The push button is extended to form two long elastic legs directly face to face, axially displaceable within the hollow body, through guiding holes pierced on the bottom of the recess. One of the legs has a portion with a configuration, that can act as a cam driver on a generally small-sized switch push button or microswitch, in a definite axial position. The microswitch is partly lodged inside a second recess, defined on the casing opposite bottom, and secured between attachment members. At least one of the legs has a bent tab at the end that acts as a retainer of the push button.

Actuator devices of the mentioned type are known from Spanish utility model application no. 8803702 and utility model no. 8703755, both of the applicant.

Bearing in mind that one of the main applications of these devices is in the field of entertainment machines, it is obvious that they have to sustain heavy duty conditions, because of the continuous effort the players make them sustain. The device must as well offer an effective protection of the switch body to which it is applied, and engagement conditions thereof, i.e. detachable and easy to mount.

All this must be obtained with a minimum cost keeping the reliability and strong condition of the assembly.

Though the utility model application no. 88 03702 means an improvement of above mentioned utility model 87 03755, when providing a stronger protection to the switch body that is partly lodged in the casing, the first model as its push button has only two legs available, one of them operative on the switch, obliges that said legs be located on both sides of the switch and taking into account the small passageway size of the casing second recess, obliged by standard size and by the need to save material, requires the legs and the push button to be made with a small wall thickness, thus weakening its structure, and in the portion of push button operation reinforcing ribs that increase the cost of obtaining the part.

Other antecedents known to the applicant are U.S. Pat. No. 4,454,397 and British Patent GB 1 233 400 which refer to push button switch assemblies.

BRIEF SUMMARY OF THE INVENTION

In order to solve the above problems this invention was conceived wherein the drive push button is extended with a third leg offset 90 degrees from the other two that remain limited to guiding and retaining functions of the frame drive push button, the third leg being applied to the switch push button operation. The switch body as in the utility model no. 88 03702 is partly inserted in the casing in its second recess but in this case the switch body is shifted toward one of the walls of the second recess and supported on its bottom, so that the switch maneuvering leg that passes through a hole near to the opposite wall can be thicker and also the push button body and the two remaining legs that are arranged through some holes offset 90 degrees, external to the lodging that receives the switch body.

The switch body remains arranged in addition between elastic appendages that clamp and protect the appendages ending with retaining configurations at its ends, this contributing to an improvement of the assembly packing and mounting.

First recess possesses near to its side wall and coming from its bottom several generatrix ribs, preferably in a number of four and angularly evenly-spaced, in order to constitute an advancement limiting stop of the drive push button that in addition to guarantying that in its limit position the protruding configuration of the third leg operates on the switch push button, it avoids the push button spring being loaded to a limit, thus increasing the working life of the spring.

It has also been foreseen that the drive push button body is in transparent condition, and it can internally lodge against its bottom wall, directly visible through the push button bottom a plate that bears inscription or symbols, squeezed by mentioned spring and locked by protruding configurations of the push button body internal wall.

Other features of the invention and the advantages thereof will become apparent from the detailed description below.

BRIEF DESCRIPTION OF THE DRAWINGS

The invention will now be described in detail with reference to the accompanying drawings wherein.

DETAILED DESCRIPTION

Figure 1:
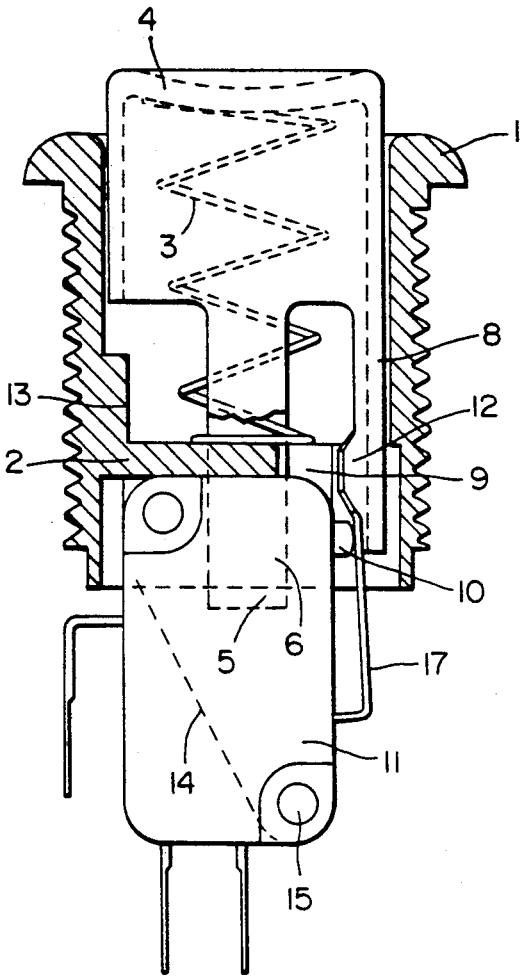
FIG. 1 is a cross-sectional view of the push button assembly of the invention.

FIG. 1 shows the push button assembly and it can be seen that its casing 1, in cross section, has first upper recess, separated from a second lower and small recess by means of an intermediate wall 2, on which is supported the spring 3, that urges a hollow drive push button 4 to an inactive position which despite the pressure on it by said spring 3, cannot move upward because it is retained by bent tabs 5 on the lower ends of each of the two legs 6, diametrically opposite each other and that emerge through the mouth piece of the second recess starting from the wall of the hollow drive push button 4.

Legs 6 have a wall thickness sufficient to fulfill the required function, i.e. to retain the push button by means of bent tabs 5 at the ends, but also they have sufficient elasticity to flex when the push button is inserted into the casing and to pass through holes 7 (see FIG. 4), each returning to its initial position when arriving at the end of the body, so that when expanded they keep the drive push button 4 retained.

Figure 3:
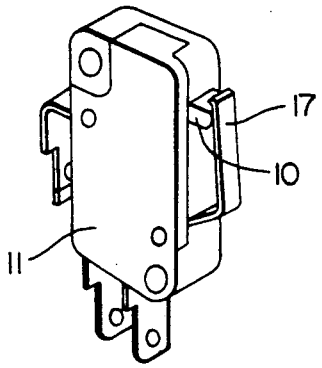
FIG. 3 is a perspective view of a microswitch which can be used in the actuator device.

The push button 4 also comprises a third leg 8, located at 90 degrees from the two legs 6 and also extending from the body wall, that penetrates into the lower recess through the hollow 9 of the wall 2 has the purpose of pressing the push button 10 that protrudes from the microswitch 11, partly located socketed in the second lower recess, due to a protrusion 12 which when drive push button 4 is pushed down, acts on a lever 17 superimposed on push button 10, depressing and operating the microswitch 11 (see FIG. 3).

In order to limit the travel of drive push button 4 so that it does not go over the point where the closure of the microswitch 11 occurs, by means of the push button 10, body 1 has available four generatrix stops 13 (only one appearing in the cross section of FIG. 1) that protrude from the internal wall of the first recess of the casing. These stops also avoid spring 3 being fully loaded making its working life longer.

Finally and by its lower part there also extends from casing 1 two triangular shaped parallel appendages 14 between which and one of the frame wall is partly inserted the switch 11, retained by protruding stubs 15, that penetrate into holes in the microswitch body appendages 14 have a thickness that allows them enough elasticity for inserting and securing the microswitch.

Figure 2:
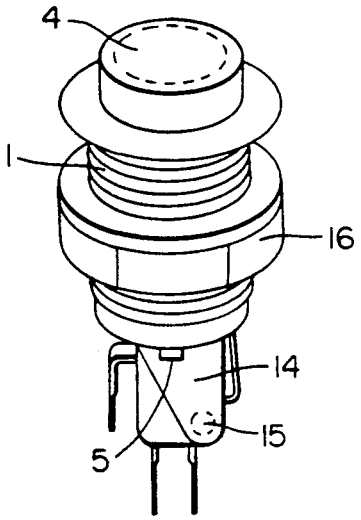
FIG. 2 is a perspective view of the push button assembly.

FIG. 2, shows the assembly including the casing 1, the drive push button 4, one fastener nut 16 to lock this assembly on a panel, the lower triangular-shaped appendages 14 with its stub 15 (in dotted line), and tab 5 that extends through the frame mouth piece an retains the drive push button 4 in the casing.

Figure 4:
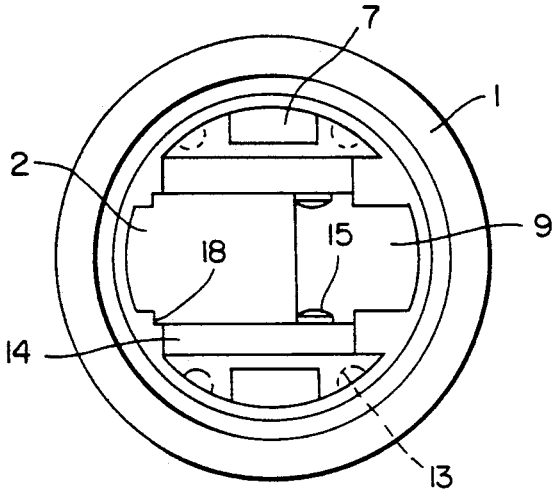
FIG. 4 is a bottom plan view of the casing showing the second recess where the microswitch is socketed.

FIG. 4 shows a bottom plan view of the casing 1 detailing the wall 2, and showing the open space 9 that allows the passing of the third leg 8 from the upper to the lower recess, the holes 7 for the passage of the two legs 6, with their end bent tabs 5, and the four stops 13 that limit the push button 4 run. The four corners 18 are also shown and indicated with small arrows, within which is guided and partly socketed the microswitch body 11 that remains engaged by the stubs 15 and the resilient appendages 14.

Figure 6:
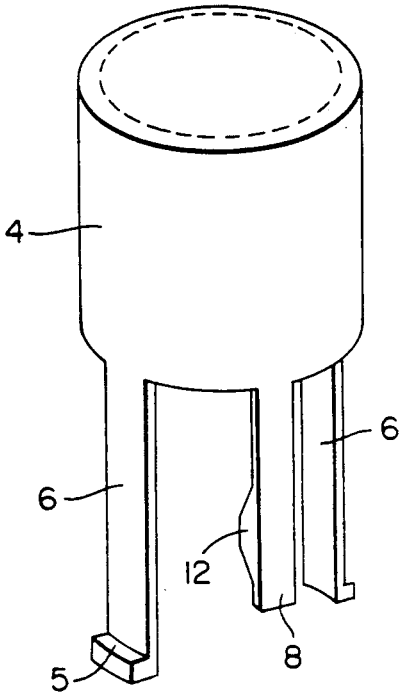
FIG. 6 is a perspective view of the drive push button.
Figure 5:
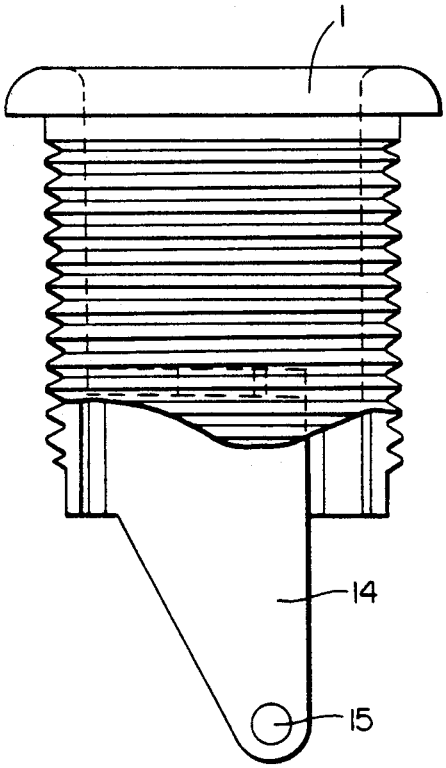
FIG. 5 is a side elevation view of the casing.

FIG. 6 clearly shows drive push button 4 in perspective with its two opposite legs 6 with bent tabs 5 at their ends and at 90 degrees between both and extending from the same body the leg 8, shorter with its pushing protrusion part 12 acting on the microswitch 11.

I claim:

1. A fingertip push button switch device, comprising:

an electrical insulated hollow casing having an externally threaded wall to be inserted through and mounted in an aperture in a support panel and to be secured by a fastening nut engaging said threaded wall;

a first upper recess in one end of said hollow casing;

a second lower and smaller recess on an opposite end of said hollow casing adapted to receive part of a switch body having a depressable actuating switch protruding therefrom;

an intermediate wall on said casing between said recesses;

a hollow drive push button in said first recess;

a spring between said intermediate wall and said push button resiliently urging said push button outwardly of said first recess;

three circumferentially spaced holes through said intermediate wall;

three elastic legs extending axially from said push button through said holes in said intermediate wall, two of said three axial legs being arranged diametrically opposite to each other for guiding and retaining said push button in said casing and a third axial leg being offset 90 degrees from said two axial legs;

a protrusion on said third leg for depressing said actuating switch when said push button is depressed in said first recess against the force of said spring;

guide means in said second recess for guiding said switch body during insertion thereof into said second recess; and two resilient oppositely spaced appendages extending from said casing outwardly from said second recess and having facing sides for engaging therebetween said switch body when inserted in said second recess and retaining means on the distal ends of said appendages for retaining said switch body in said second recess.

2. Push button switch device as claimed in claim 1, wherein:

one of said holes through said intermediate wall is located at the edge of said wall between the other two holes and between the positions of said two oppositely spaced appendages.

3. Push button switch device as claimed in claim 1 wherein:

said guide means in said second recess comprises protruding shoulders on said casing protruding into said second recess.

4. Push button switch device as claimed in claim 1 wherein:

two of said three holes in said intermediate wall are diametrically opposite each other at substantially the same circumferential position as said two appendages, so that said two diametrically opposite legs of said push button extend through said two diametrically opposite holes and are positioned partly between said appendages; and retaining tabs are provided on the distal ends of said two diametrically opposite legs extending at right angles to said two legs and radially outwardly thereof for engagement with said casing for retaining said push button in said casing against the force of said spring.

* * * * *